US008020225B2

(12) United States Patent
Vrzalik et al.

(10) Patent No.: US 8,020,225 B2
(45) Date of Patent: Sep. 20, 2011

(54) SIDE RAIL PAD/PANEL METHOD FOR PATIENT SUPPORT APPARATUS

(75) Inventors: John H. Vrzalik, San Antonio, TX (US); Cesar Z. Lina, Universal City, TX (US)

(73) Assignee: KCI Licensing, Inc., San Antonio, TX (US)

( * ) Notice: Subject to any disclaimer, the term of this patent is extended or adjusted under 35 U.S.C. 154(b) by 13 days.

(21) Appl. No.: 12/484,771

(22) Filed: Jun. 15, 2009

(65) Prior Publication Data

US 2009/0249543 A1 Oct. 8, 2009

Related U.S. Application Data

(62) Division of application No. 11/355,680, filed on Feb. 15, 2006, now Pat. No. 7,559,101.

(60) Provisional application No. 60/653,714, filed on Feb. 16, 2005.

(51) Int. Cl.
*A47C 21/08* (2006.01)

(52) U.S. Cl. ..... 5/430; 5/425; 5/427; 5/429

(58) Field of Classification Search ..... 5/424–430, 5/663

See application file for complete search history.

(56) References Cited

U.S. PATENT DOCUMENTS

| | | | | | |
|---|---|---|---|---|---|
| 5,381,571 | A * | 1/1995 | Gabhart | 5/430 |
| 5,481,772 | A * | 1/1996 | Glynn et al. | 5/663 |
| 5,781,945 | A * | 7/1998 | Scherer et al. | 5/426 |
| 5,898,964 | A * | 5/1999 | Stanley | 5/663 |
| 6,038,721 | A * | 3/2000 | Gordon | 5/663 |
| 6,401,277 | B1 * | 6/2002 | Savage et al. | 5/430 |
| 6,564,404 | B1 | 5/2003 | Nanahara | 5/430 |
| 6,582,023 | B2 | 6/2003 | Houston et al. | 297/470 |
| 6,721,975 | B1 * | 4/2004 | Lemire | 5/430 |
| 6,820,293 | B2 * | 11/2004 | Alverson | 5/425 |
| 6,829,793 | B2 * | 12/2004 | Brooke et al. | 5/425 |
| 6,951,036 | B2 * | 10/2005 | Lemire | 5/425 |
| 2003/0051291 | A1 * | 3/2003 | Brooke et al. | 5/430 |
| 2004/0060111 | A1 * | 4/2004 | Alverson | 5/425 |
| 2005/0071921 | A1 * | 4/2005 | Risk, Jr. | 5/425 |
| 2007/0180617 | A1 * | 8/2007 | Kramer et al. | 5/425 |
| 2009/0007334 | A1 * | 1/2009 | Stryker et al. | 5/430 |

OTHER PUBLICATIONS

Office Communication, issued in U.S. Appl. No. 11/355,680, dated Aug. 4, 2008.

Office Communication, issued in U.S. Appl. No. 11/355,680, dated Apr. 2, 2008.

* cited by examiner

*Primary Examiner* — Michael Trettel

*Assistant Examiner* — William Kelleher

(74) *Attorney, Agent, or Firm* — Fulbright & Jaworski L.L.P.

(57) ABSTRACT

Methods and apparatus to occlude openings and spaces of side rails are provided. One embodiment includes a pad body panel having attachment openings each defining a pivot axis. The embodiment includes follower slots in the pad body panel each to receive a bracket pivot of a pivot arm, each follower slot having a configuration centered on the attachment opening of the pivot axis.

16 Claims, 7 Drawing Sheets

SIDE RAIL PAD/PANEL METHOD FOR PATIENT SUPPORT APPARATUS

CROSS REFERENCE TO RELATED APPLICATIONS

This application is a divisional of currently-pending U.S. application Ser. No. 11/355,680 filed Feb. 15, 2006, which claims the benefit of U.S. provisional Application No. 60/653,714, filed Feb. 16, 2005, the entire disclosures of which are each incorporated herein by reference.

BACKGROUND OF THE INVENTION

1. Field of the Invention

The present invention relates to side rail systems utilized on patient support platforms and beds. The present invention relates more specifically to a system of movable pads positioned on and operable in conjunction with the side rails of patient support platforms, hospital beds, and the like.

2. Description of the Related Art

The basic patient support system utilized in most hospitals and extended care facilities provides a number of essential elements intended to accommodate a variety of patient conditions and situations. The basic support system incorporates a mattress positioned on a platform or other frame, most commonly connected with an underlying base frame mounted on casters for mobility. There is typically a head board and a foot board to enclose the upper and lower end of the mattress platform. There are also typically a number of side rails that may be raised or lowered to alternately enclose the mattress or allow the patient access to or exit from the bed. In addition, most such patient support systems incorporate articulating frames and mattresses that allow an upper (head) section to be raised at an angle with respect to a middle or torso section, and likewise for a lower (foot) section to be lowered at an angle below the middle or torso section. Such articulations facilitate both the comfort of the patient and the ease with which the patient may enter and exit the bed.

The combination of side rails and articulating frames on patient support surfaces has resulted in the development of very specific design features that are incorporated into the side rails to allow their movement into either raised or lowered positions both while the bed is horizontally planar and while the bed is articulated into angled configurations. In most instances, the requirements for bed articulation dictate that each side rail be divided into two parts, an upper side rail associated with the head section of the bed and a lower side rail covering the balance of the side of the bed enclosure. Mirror images of these side rails are positioned on an opposite side of the bed, and operate in conjunction with the head board and foot board to fully enclose the patient within the bed or mattress area. The various components of the basic patient support system that serve to enclose the patient within the platform area give rise to new problems associated with the safety and comfort of the patient. Because it is necessary for these various enclosing panels to move and articulate themselves as the bed frame moves and articulates, there are necessarily gaps, openings, and passages between the various panel components, and between the panel components and the mattress itself. Efforts have been made in the past to appropriately fill the gaps and spaces between the various components that make up the patient support system. For the most part these efforts have focused on the addition of loose cushions to block the openings between the various enclosing panels and side rails. Such systems clearly suffer from the inability to maintain a fixed association between the cushions and the patient support platform and to accommodate the articulation of the bed frame.

As discussed in more detail below, various governmental agencies and standards organizations have identified spatial zones of concern that relate to the safety and comfort of the patient positioned on the typical hospital bed utilizing side rails. For those hospital beds and patient support platforms that have an articulating structure, these elements take on added dimensions depending upon the various orientations of the support platform components. The typical articulating patient support platform that utilizes side rails will incorporate split side rails on each side of the bed. A first set of side rails are associated with the upper or head portion of the support platform, and move in conjunction with it as it is raised and lowered. A second set of side rails are typically associated with the lower and/or middle portion of the patient support platform and move in conjunction therewith. A number of existing bed designs include mechanisms that allow the knee area of the platform to articulate. Although the angle that is achieved is generally less than that between the upper (head) section and the middle (torso) section, the rails that are connected to the lower (foot) section do move in conjunction with the lower (foot) section as it is raised and lowered with respect to the middle (torso) section. Each of the side rails also move (typically through an arc of rotation to the side and down) into a lowered and stored position away from the side of the mattress as is known in the art. Because of the relative movement between the two side rail components that occurs with the above articulations, it is necessary to structure and design the components to both accommodate the articulating motion, the ability to rotate the side rails out of the way, and the continued purpose of having side rails, namely the appropriate enclosure of the patient support area.

While efforts have been made in the past to improve safety and comfort for the patient, such efforts often fail to allow the continued versatility associated with existing articulating bed frames. Such safety and comfort panels and pads very often must be removed before a bed platform can be articulated into an elevated or lowered position. It would be desirable to have a system of side rail pad components that continued to allow full movement of the bed frame components at the same time it provided for improved safety and comfort to the patient. It would further be desirable that such components could be moved from elevated positions adjacent or in contact with the sides of the patient support mattress to lowered positions separated from the patient support mattress, such movement occurring automatically in conjunction with the same or similar movement of the side rails themselves.

SUMMARY OF THE INVENTION

It is therefore an object of the present invention to provide a side rail pad system for use in conjunction with a patient support apparatus, which serves to improve the safety and comfort of the patient, especially in a support platform that incorporates articulating elements. The present invention is directed towards a system that improves the safety and comfort of the patient without sacrificing versatility and articulation movement in the patient support platform. The addition of the side rail pad system of the present invention provides overall improvement to the hospital bed or patient support platform. The goal is to achieve these improvements without significantly altering the structural characteristics of existing patient support devices by allowing the retrofit of existing devices with the components and elements of the present invention.

Efforts are currently underway by governmental agencies and standard setting organizations to define and clarify requirements for patient support systems including the requirements that are directed towards the safety and comfort of the patient with regard to the enclosures that surround the mattress or patient support platform. These efforts have identified a variety of spatial zones within the typical patient support platform or hospital bed that may be of concern from a safety and comfort standpoint. The present invention is directed towards addressing these zones of concern by providing appropriate closures or barriers that are generally identified and agreed upon as helpful for the safety and comfort of the patient.

In fulfillment of these and other objectives, in various embodiments of the present invention a set of additional side rail system components are provided that are operable in association with hospital beds and other patient support systems that are designed to articulate so as to elevate an upper or head portion of the bed, with respect to a middle or torso portion of the bed, and so as to lower a lower or a foot portion of the bed with respect to the middle portion of the bed. In conjunction with such patient support systems, in various embodiments, a system of side rail pad/panels that are provided that are positioned on, and movably secured to, the existing side rails. The pad/panels can move into position and out of position with the corresponding movement of the side rails. Likewise, the pad/panels maintain their functional positioning even while the patient support system articulates from an initially planar configuration to a multi-planar configuration.

In various embodiments, the pad/panel system provides a parallel, planar, "follower" panel that generally is positioned between each of the movable side rails and the mattress or patient support surface of the bed. An arrangement of offset rotational axes allow the use of the existing side rail bracket arms to both re-attach to the existing side rails and at the same time support and position the added pad/panels.

The pad/panels associated with each of the side rails are configured to at least partially occlude various spaces and openings between the side rails themselves, between the side rails and the head board of the bed, and between the side rails and the side of the mattress system placed on the bed.

The pad/panels are sized, shaped and structured to maintain the necessary access to levers and latches associated with the positioning and release of the existing side rails on the bed. Additionally, the pad/panels are structured to maintain other access apertures on the existing side rails, unless the side rail (and the associated pad/panel) is directed out of the way into a lowered and/or stowed position.

The pad/panels and the associated mechanics are designed to facilitate the retrofitting of an existing side rail system without the need for significant, if any, modification of the existing side rail structures. The pad/panels may be installed in place by the simple removal of the side rails from their existing side rail bracket arms (two per side rail typically), the placement of the pad/panel, and the re-attachment of the combined systems to the side rail bracket arms. An alternate embodiment utilizes a removable edge cap that allows the attachment of the pad/panel without the removal of the side rail from the bracket arms.

BRIEF DESCRIPTION OF THE DRAWINGS

References herein below to parts of a patient support system, such as a hospital bed, will refer to: the "lower" portion of the bed as meaning that part of the bed associated with the foot and lower body of the patient when the patient is lying in the bed; the "upper" portion of the bed as meaning that part of the bed associated with the head and upper body of the patient when the patient is lying in the bed; the "right" side of the bed as meaning the side of the bed to the patient's right when the patient is lying on his or her back in the bed; and the "left" side of the bed as meaning the side of the bed to the patient's left when the patient is lying on his or her back in the bed.

DETAILED DESCRIPTION OF THE PREFERRED EMBODIMENTS

Figure 1:
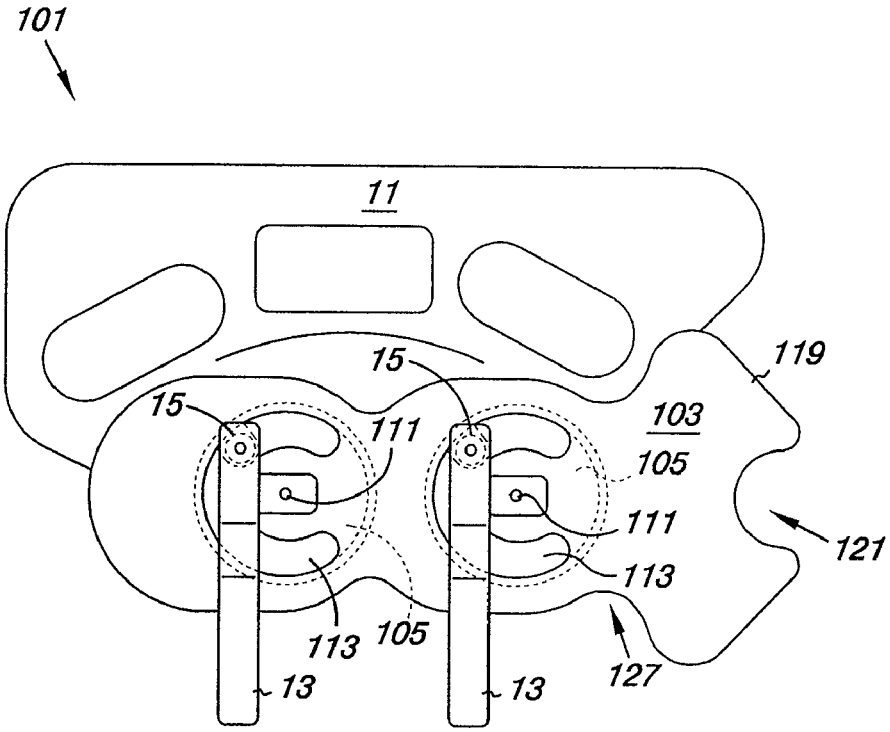
FIG. 1 is a side view (from within the confines of the bed) of a lower right side rail incorporating the side rail pad system of the present invention shown in an elevated position.

The structure of the patient support platform discussed herein is intended to be typical of the type of hospital bed that would benefit from the structures and functions of the system of the present invention. Other bed frames and patient support systems could equally be suited for an application of the concepts of the present invention with only minor modifications to the structures described herein.

The following descriptions involve the details of the attachment and operation of each of the pad/panels of the present invention with one of four (typically) side rails associated with the hospital bed or the like. In most every case where a left or right side component is being described, the corresponding opposite side of the bed would utilize a mirror image of the described component. Much of the following description, therefore, involves only one side of the complete system and it is understood that an identical description could be made of the corresponding opposite side components.

In the case of the lower side rail pad/panels it is to be noted that a single configuration is all that is required as the mirror image appropriate for the opposite side of the bed is in fact simply the same component turned over (rotated within the same plane 180°). In the case of the upper side rail pad/panel the mirror image is not, in the preferred embodiment, the same exact component. The reasons for this distinction become clear from the following description of the drawing figures.

Reference is made first to FIG. 1 for a description of the installation and operation of a first of the side rail pad/panel components of the system of the present invention. FIG. 1 is a side view (from within the confines of the bed) of a lower right side rail incorporating a pad/panel of the present invention, both of which are shown in an elevated position. Existing side rail 11 (as viewed from the bed looking outward) is pivotally attached to two existing side rail arm brackets 13 at side rail pivot bearings 15. These pivoting connections allow the side rail to rotate towards the foot (or head) of the bed frame to an intermediate "half-way" point and then further to a lowered extreme where they may be stowed out of the way. In some types of beds this stowed position includes directing the side rail in towards the center of the bed frame to further remove it from use and obstruction.

Moveable side rail pad/panel assembly 101 that is ultimately attached to the existing structure includes pad body panel 103, rotatable cover disk 105 (shown in dashed line detail in this view) and the associated hardware for the pivoting attachment of these components. Pad body panel 103 is a specifically configured panel that comprises extensions 119 and indentations 121 and 127 sized and positioned to serve the objectives mentioned above of occluding spaces and openings in the existing side rail system. In addition, as mentioned above, the indentations 127 are positioned and placed to continue to allow access to the necessary control levers and the like which are associated with the operation of the bed frame and of the side rails themselves.

Side rail bracket arms 13 in this view are seen to have a minor modification to facilitate both the attachment of the pad/panel 103 and the proper movement of the pad/panel in tandem with the corresponding movement of the side rail. In this case, it is necessary for the pad/panel to not only lower and "collapse" down with the side rail, it is also necessary that it shift laterally in the process. This requirement for the lower side rail panels is due in part to the function the extension 119 plays in partially occluding the gap between the existing side rails of the bed frame as the frame moves through its various articulating configurations. The short extension shown positioned at right angles to the existing bracket in each case is either integral to a new "replacement" bracket that is included with the installation of the system or is an attachable component (such as with bolts and screws or the like) as part of the installation process.

In any case, a second pivot axis is established offset from the pivot axis already present at the existing side rail pivot bearing 15. This second pivot axis is maintained by pad pivot bolt 111 which serves to hold the panel 103 and the cover disk 105 to the bracket arm 13. As the attached components rotate about this new pivot point, the side rail itself continues to rotate about the side rail pivot bearing 15 which is now centered in and travels in follower slot 113. This semi-circular (plus) slot allows the panel to rotate with respect to the bracket arms about a different axis of rotation from the side rail itself and to "follow" the side rail in a generally parallel but displaced motion through both the aforementioned half-way point and through to the fully lowered and stowed position.

Figure 2:
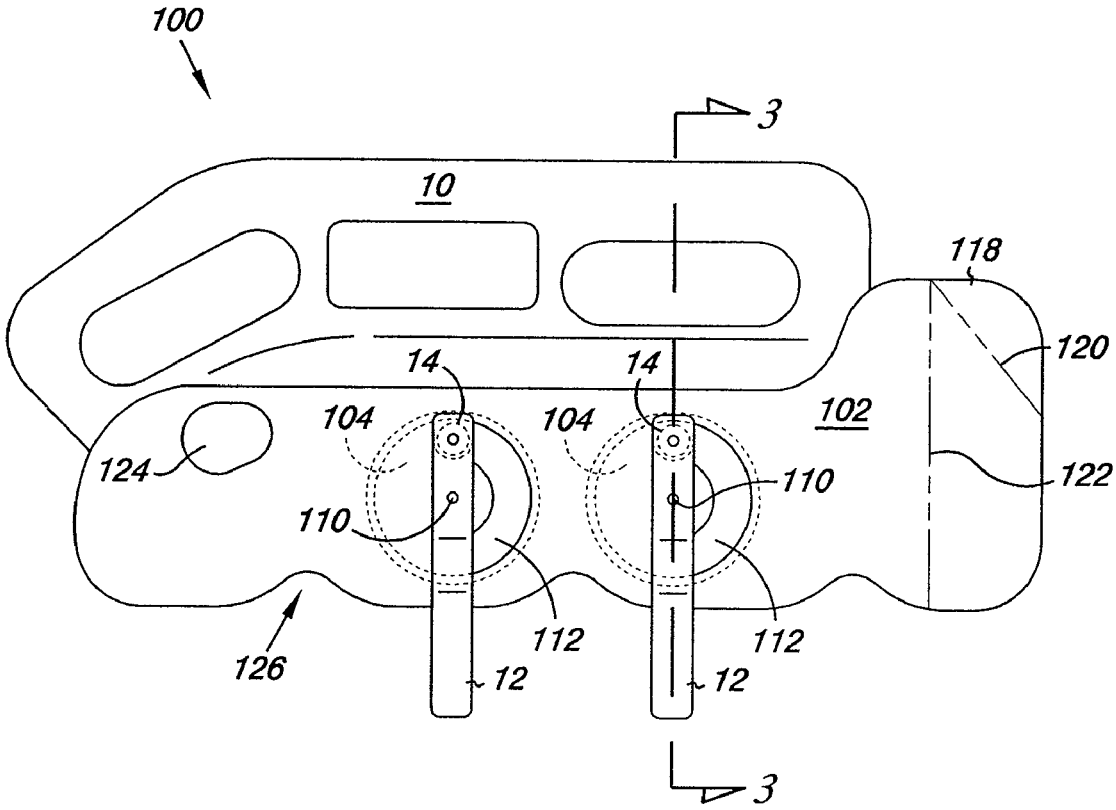
FIG. 2 is a side view (from within the confines of the bed) of an upper right side rail incorporating the side rail pad system of the present invention shown in an elevated position.
Figure 5:
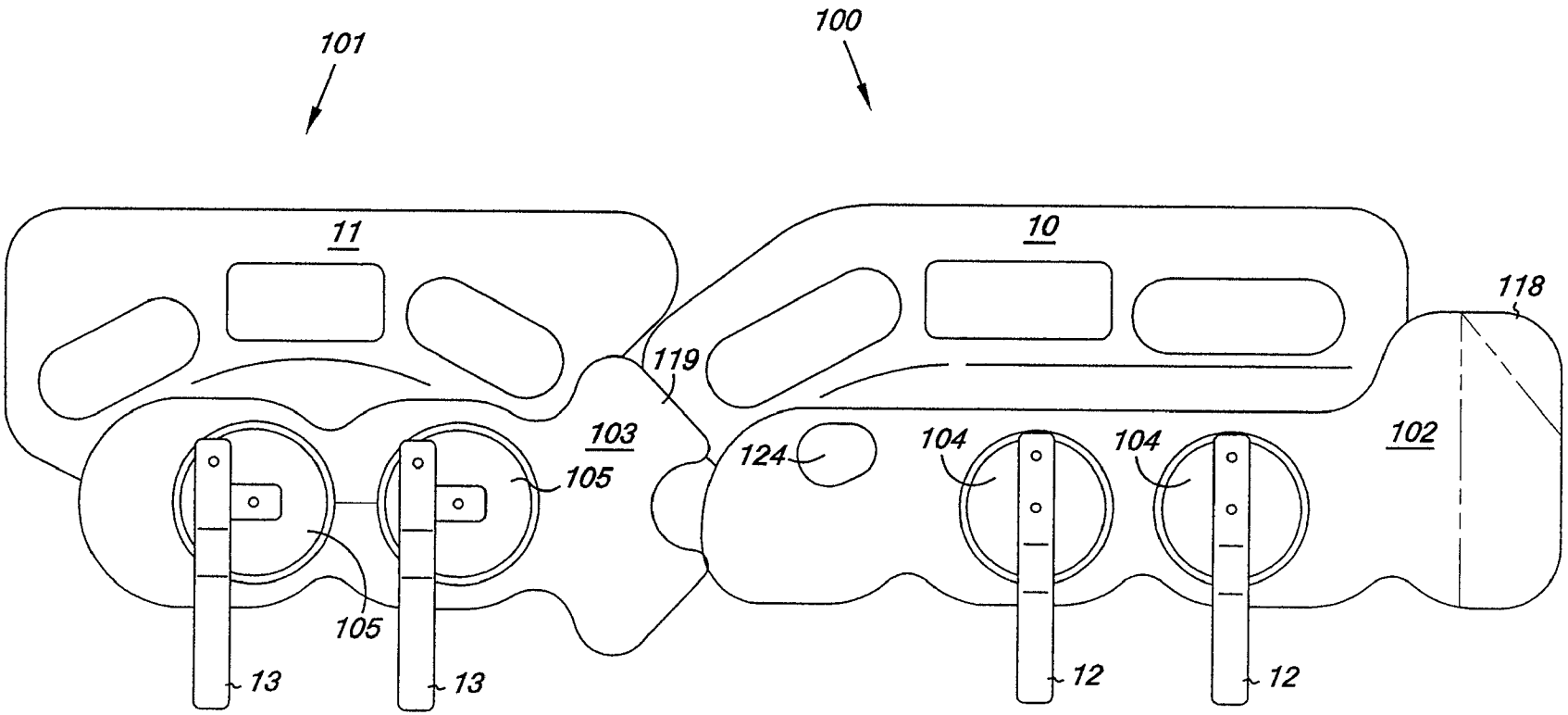
FIG. 5 is a side view (from within the confines of the bed) of the entire right side rail incorporating the side rail pad system of the present invention shown in an elevated position.

FIG. 2 is a side view (from within the confines of the bed) of the upper right side rail incorporating the side rail pad system of the present invention shown in an elevated position. FIG. 5 shows these two right side rail panels side by side as they would appear on the bed in a raised position. Both the existing components and the added components shown in FIG. 2 generally correspond to corollary components described above with respect to the lower side rail assembly.

In FIG. 2, existing side rail 10 (as viewed from the bed looking outward) is pivotally attached to two existing side rail arm brackets 12 at side rail pivot bearings 14. These pivoting connections allow the side rail to rotate towards the head of the bed frame to an intermediate "half-way" point and then further to a lowered extreme where they may be stowed out of the way. Moveable side rail pad/panel assembly 100 that is ultimately attached to the existing structure includes pad body panel 102, rotatable cover disk 104 (shown in dashed line detail in this view) and the associated hardware for the pivoting attachment of these components. Pad body panel 102 is a specifically configured panel that comprises extension 118, aperture 124, and indentations 126, sized and positioned to serve the objective mentioned above of occluding spaces and openings in the existing side rail system. In addition, as mentioned above, the indentations 126 are positioned and placed to continue to allow access to the necessary control levers and the like which are associated with the operation of the bed frame and of the side rails themselves.

Side rail bracket arms 12 in this view are seen not to require the modification discussed above with the lower side rail structures, in order for the pad/panel 102 and the proper movement of the pad/panel in tandem with the corresponding movement of the side rail. In this case, it is only necessary for the pad/panel to lower (through a sideways arc) and "collapse" down with the side rail. Extension 118 in this case serves to partially occlude the gap between the existing upper side rail and the headboard of the bed frame. The extension 118 includes two bends along axes 120 and 122 to further "wrap" the corner opening between the upper side rail and the headboard of the bed frame. These angled sections are discussed in more detail below with respect to FIG. 9.

In this case, a second pivot axis is established offset only in the vertical from the pivot axis already present at the existing side rail pivot bearing 14. This second pivot axis is maintained by pad pivot bolt 110 which serves to hold the panel 102 and the cover disk 104 to the bracket arm 12. As the attached components rotate about this new pivot point, the side rail itself continues to rotate about the side rail pivot bearing 14 which is now centered in and travels in follower slot 112. This semi-circular slot allows the panel to rotate with respect to the bracket arms about a different axis of rotation from the side rail itself and to "follow" the side rail in a generally parallel but displaced motion through both the aforementioned half-way point and through to the fully lowered and stowed position.

Figure 3:
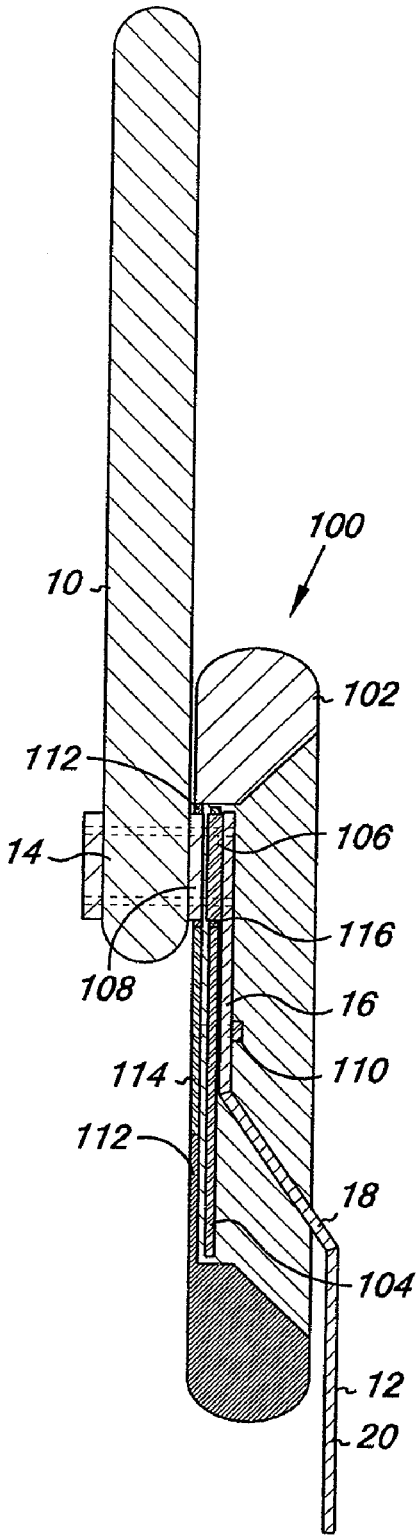
FIG. 3 is a cross sectional view taken along section line 3-3 shown in FIG. 2 of the side rail pad system of the present invention in an elevated position.

FIG. 3 is a cross sectional view taken along section line 3-3 shown in FIG. 2 of the upper right side rail pad component of the system of the present invention shown in an elevated position. In this view, the points of attachment and rotation within the system are disclosed in greater detail. In addition to the components already discussed above, the positioning of rotatable cover disk 104 with respect to the pad body panel outer wall 114 and the follower slot 112 is made clear. It is noted that arm spacer 106 and side rail spacer 108 are included in this configuration although their use may be optional depending on the tolerances associated with the reattachment of the side rail to the bracket arms. In this embodiment, these spacers "ride" within both the follower slot 112 (which is cut into pad body panel outer wall 114) and the cover disk notch 116. Also seen in this cross sectional view is the circular depression into which the angled bracket arm extends and mounts. Bracket arm 12 is seen to comprise an arm mount section 16, an arm shoulder section 18, and an arm strut section 20. Bracket arm extends past the arm strut section 20 to a point where it is further bent and structured to be rotatably attached to the bed frame itself in a manner typical in the industry and not subject of the present disclosure. Typically, a release lever is positioned on the bed frame that allows the rotation of this opposite end of the bracket arm into both the mentioned half-way position and the fully lowered position.

Figure 4:
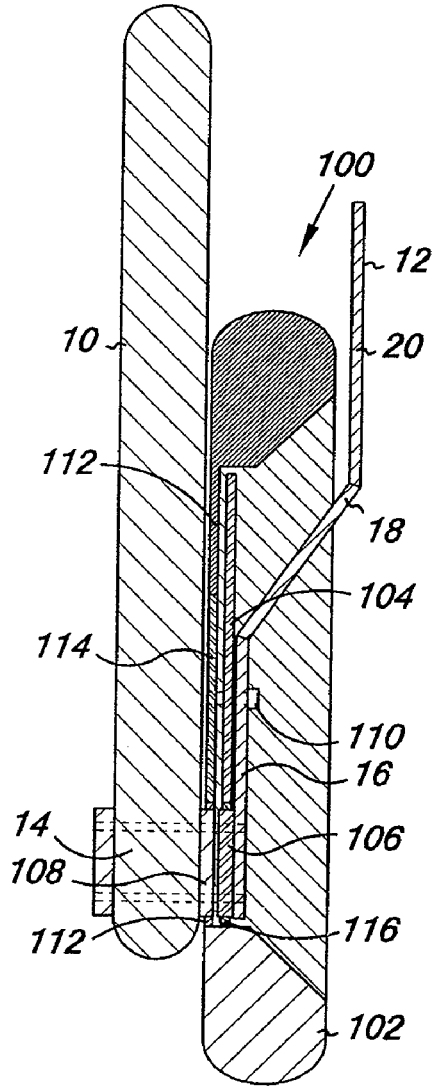
FIG. 4 is a cross sectional view taken along section line 4-4 shown in FIG. 7 of the side rail pad system of the present invention in a lowered position.
Figure 7:
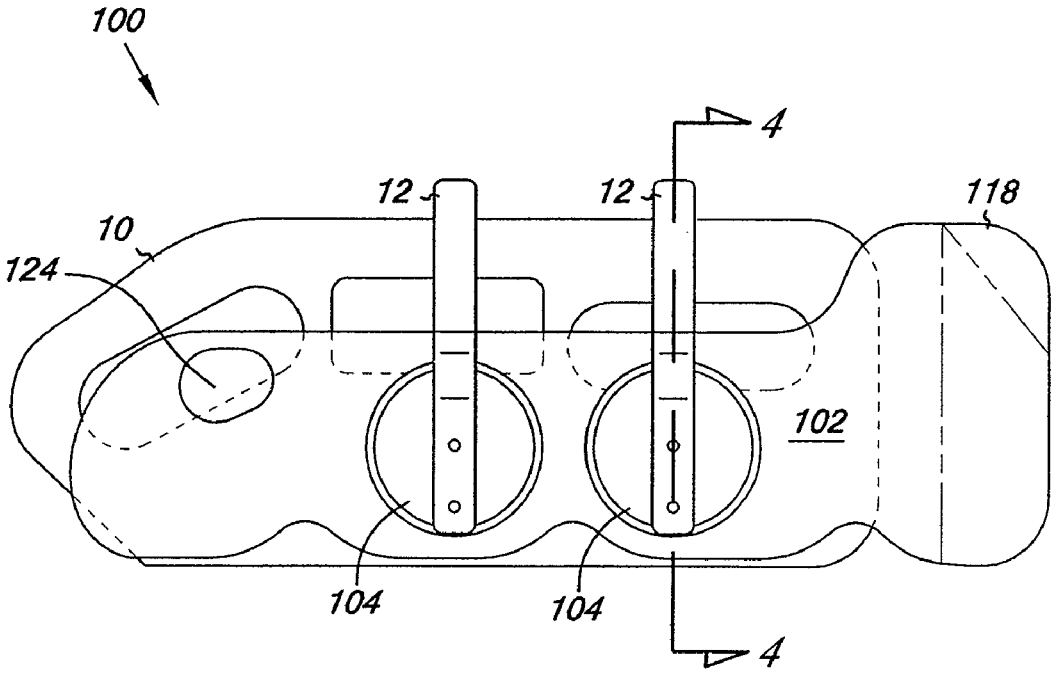
FIG. 7 is a side view (from within the confines of the bed) of an upper right side rail incorporating the side rail pad system of the present invention shown in a lowered position.

FIG. 4 is a cross sectional view taken along section line 4-4 shown in FIG. 7 of the same side rail pad system of the present invention shown in FIG. 3 but this time in a lowered position. All of the same components discussed above with regard to FIG. 3 are again shown and disclosed in this view, albeit simply rotated 180° on the indicated axes.

Reference is now made to FIG. 5 for a side view (from within the confines of the bed) of the entire right side rail incorporating the side rail pad/panel system of the present invention shown in an elevated position. In this view it is apparent that the above mentioned configurations of the added pad/panels serve to appropriately (partially) occlude the various gaps between the side rails and between the side rails and the balance of the bed frame. It is understood that the positioning of the pad/panels as shown and described also serves to partially "fill" the long planar space that previously existed between the side rails in their elevated positions and the mattress system in place on the bed frame. The longitudinal axis line across the entirety of the view in FIG. 5 represents a line of contact with the side wall of the mattress system in place.

Figure 6:
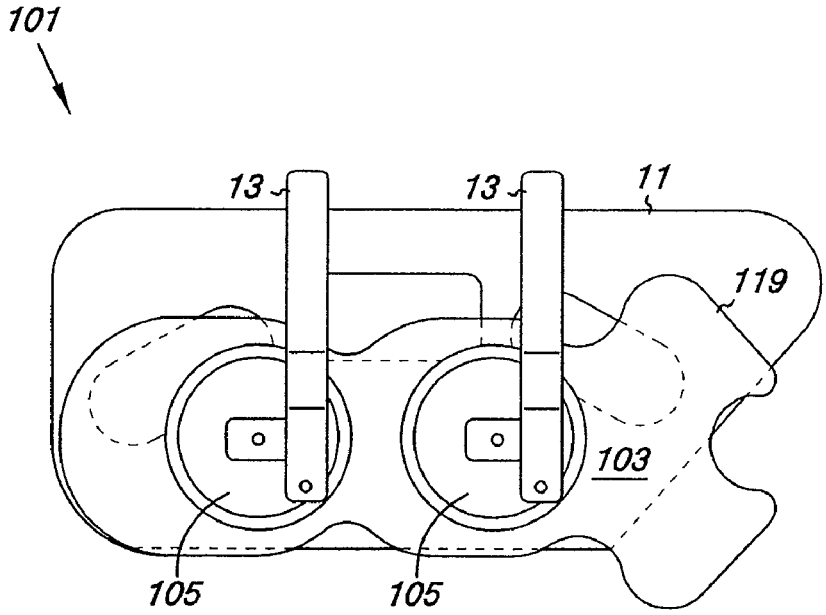
FIG. 6 is a side view (from within the confines of the bed) of a lower right side rail incorporating the side rail pad system of the present invention shown in a lowered position.

Reference is now made to FIGS. 6 & 7 for a view of each of the representative side rail pad/panel components attached to their respective side rails as in FIGS. 1 & 2, but in this view in a lowered position. FIG. 6 is a side view (from within the confines of the bed) of a lower right side rail incorporating the side rail pad system of the present invention shown in a fully lowered position. In this view, rotatable cover disk 105 is shown as it would in fact cover the follower slot 113 in this arrangement.

Likewise, FIG. 7 is a side view (from within the confines of the bed) of an upper right side rail incorporating the side rail pad system of the present invention shown in a fully lowered position. In this view as well, rotatable cover disk 104 is shown as it would in fact cover the follower slot 112 in this arrangement.

Figure 8:
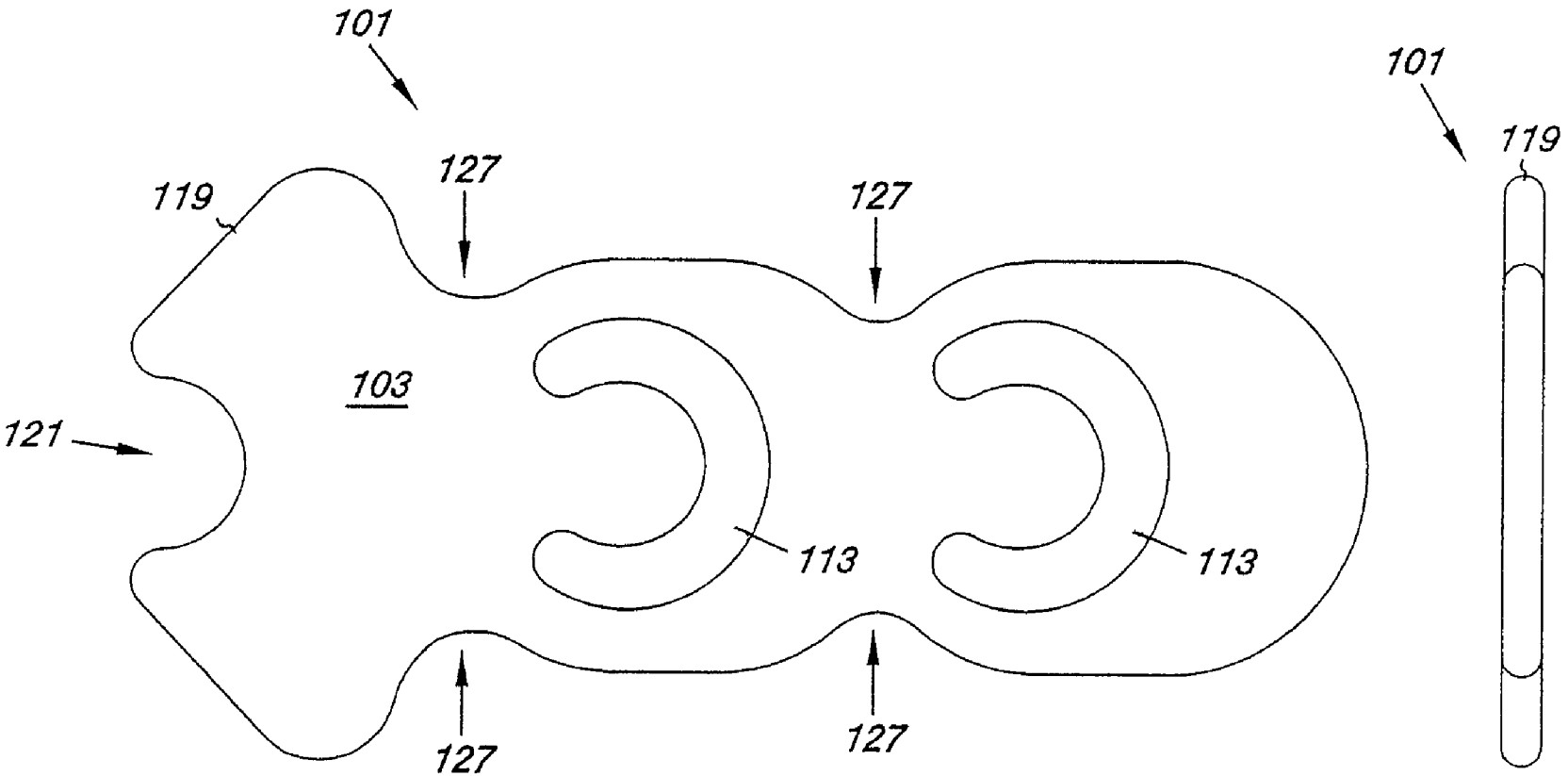
FIG. 8 is a detailed plan and edge view of the configuration of the interchangeable lower side rail pad panel of the present invention.

FIG. 8 is a detailed plan and edge view of the configuration of the interchangeable lower side rail pad panel of the present invention. As mentioned above, one advantage of this particular configuration is the ability to use the very same structure on either side of the bed frame by simply turning the panel over. This ability is achieved by structuring the panel with an appropriate symmetry both in its extensions 119 and in the follower slot 113. The panel thus configured may, in the preferred embodiment, be constructed of any of a number of durable, resilient or semi-rigid materials that will retain their generally planar configuration throughout the movement of the attached system. Polymer plastic walled panels with foam filled cores or the like could serve as appropriate materials for these structures. The width of these panels (seen on edge in FIG. 8) would be similar in width to that of the side rails themselves. Typically, this width would be on the order of 2-5 cm. The surface of the panel material should provide a smooth enough face to allow the rotatable disk and the panel walls to slide against each other during rotation of the system.

Figure 9:
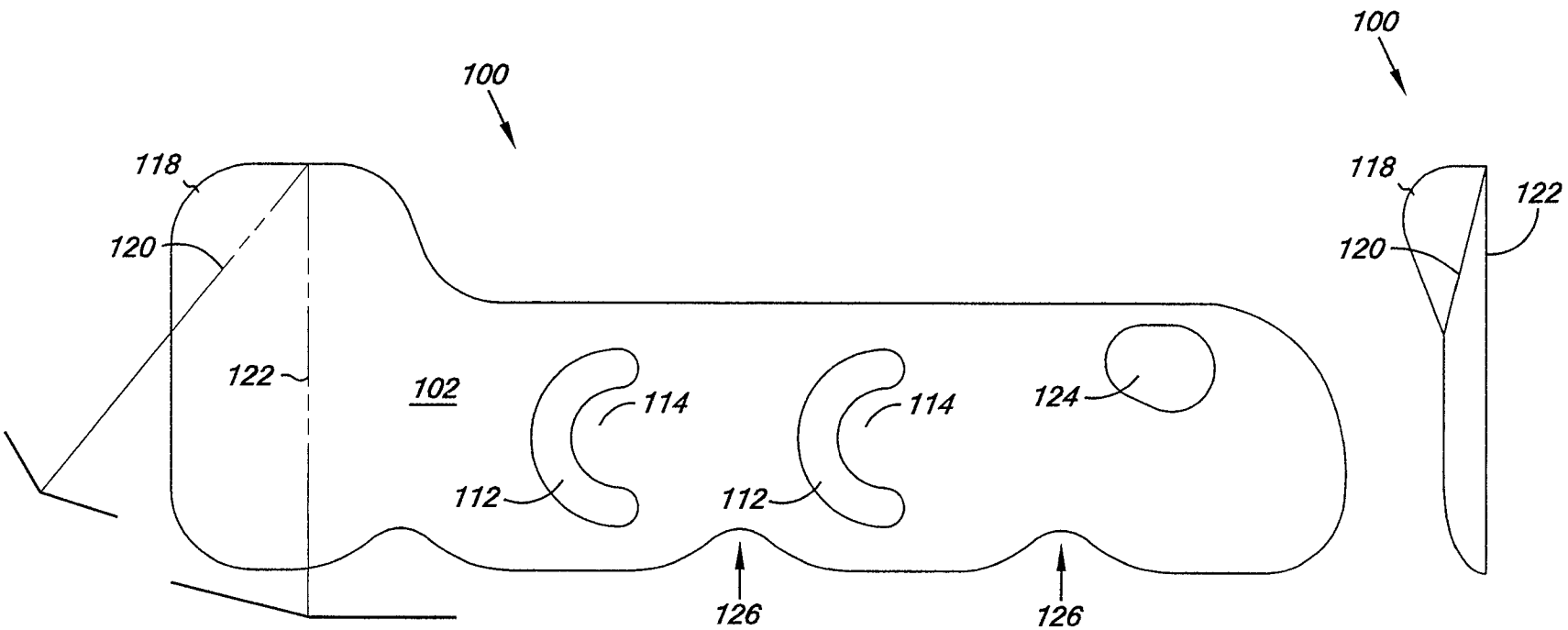
FIG. 9 is a detailed plan and edge view of the configuration of the upper side rail pad panel of the present invention.

FIG. 9 is a detailed plan and edge view of the configuration of the upper side rail pad/panel of the present invention shown in much the same manner as the lower pad/panel is shown in FIG. 8. In this view, the angles of the bends discussed above in this panel are more clearly disclosed. Once again, these bent sections serve to wrap around the corner opening between the side rail and the headboard of the bed and to at least partially occlude that opening.

Figure 10A:
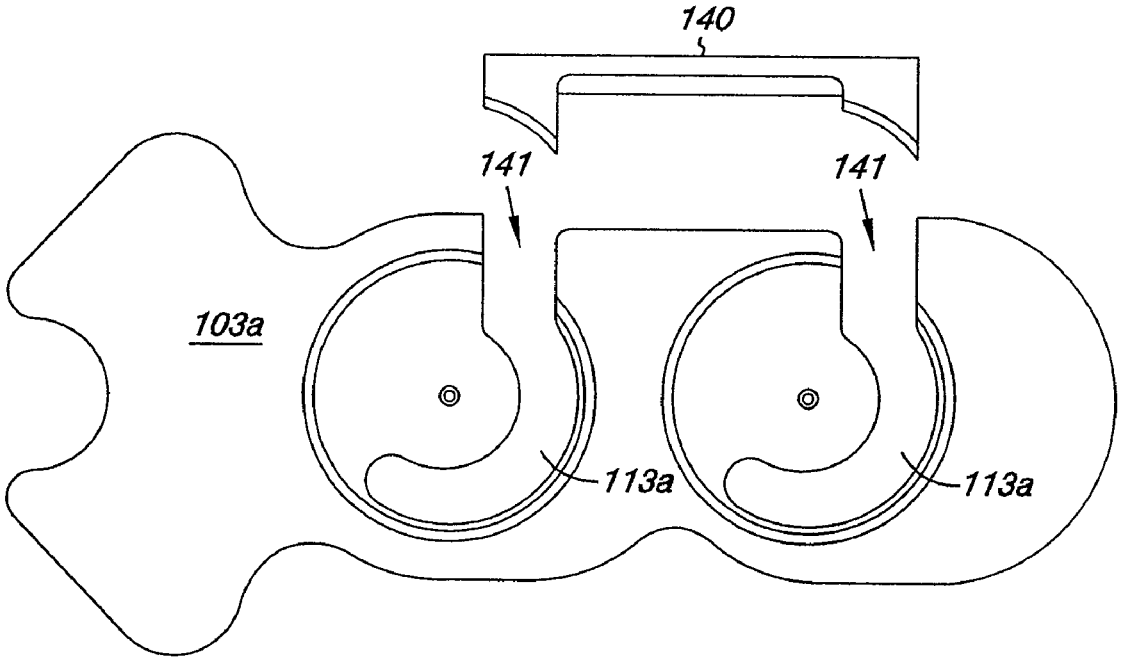
FIG. 10A is a detailed plan view of an alternate configuration of the interchangeable lower side rail pad panel of the present invention having a removable edge cap.
Figure 10B:
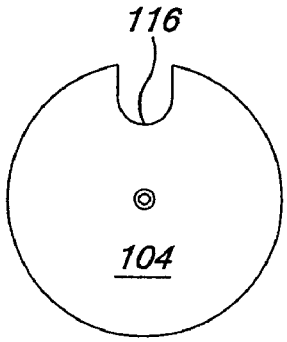
FIG. 10B is a detailed plan view of a typical rotatable cover disk used as part of the side rail pad system of the present invention.

FIG. 10A is a detailed plan view of an alternate configuration of the interchangeable lower side rail pad/panel of the present invention having a removable edge cap. As indicated above, it may be desirable to structure the retrofit capabilities of the system of the present invention to altogether avoid the necessity of removing the side rail from the bracket arms. The configuration of the panel 103*a* shown in this view (and applicable to the upper panel structure as well) includes an edge cap 140 which may be removably attached to the main body of panel 103*a* so as to open or close access to the follower slots 113*a*. When open as shown in the figure, the side rail pivot bearing attachment points may be directed (slid) into the openings 141 in the panel and directed to rest within the follower slots 113*a* as appropriate. The edge cap 140 would then be replaced into position on the panel 103*a* and attached thereto by any of a number of well known methods for such attachment as with threaded screws and bolts or the like. In any case, as with the previously described embodiments, rotatable cover disk 104 and its cover disk notch 116 are likewise placed and positioned to engage the side rail pivot bearing section of the existing side rail structure. The basic configuration of the rotatable cover disk is shown in FIG. 10B.

Although the present invention has been described in terms of the foregoing preferred embodiments, this description has been provided by way of explanation only, and is not intended to be construed as a limitation of the invention. Those skilled in the art will recognize modifications of the present invention that might accommodate specific existing patient support structures or hospital bed configurations. Such modifications as to size, and even configuration, where such modifications are merely coincidental to existing structures of the bed, do not depart from the spirit and scope of the invention.

What is claimed is:

1. A method of occluding openings between side rails positioned on a same side of a hospital bed and between a side rail and a headboard of the hospital bed, comprising:

positioning a pad body panel adjacent the openings;

attaching the pad body panel to the side rail to allow the pad body panel to at least partially occlude the openings as the pad body panel and the side rails move together relative a bed frame between a lowered position to an elevated position, wherein the side rail is coupled to a side rail bracket arm and wherein the pad body panel and the side rail rotate about different axes of rotation with respect to the side rail bracket arm; and providing a semi-circular slot in the pad body panel to allow the pad body panel and the side rail to rotate about different axes of rotation with respect to the side rail bracket arm.

2. The method of claim 1, including positioning an extension of the pad body panel to occlude the opening between the side rail and the headboard.

3. The method of claim 2, including bending the extension of the pad body panel about a first predefined axis to occlude an opening between the side rail and the headboard.

4. The method of claim 3, including bending the extension of the pad body panel about a second predefined axis to occlude an opening between the side rail and the headboard.

5. The method of claim 1, including positioning one of an aperture and an indentation in the pad body panel to allow for access to control components associated with the operation of the bed frame.

6. The method of claim 1, wherein positioning the pad body panel includes: removing an end cap from the pad body panel;

fitting the pad body panel next to the side rail; and placing the end cap back on the pad body panel to attach the pad body panel to the side rail.

7. The method of claim 1 wherein attaching the pad body panel to the side rail comprises removing the side rail from the side rail bracket arm, placing the pad body panel on the side rail, and attaching the side rail to the side rail bracket arm.

8. A method of occluding openings in a side rail system of a hospital bed, comprising:

positioning a pad body panel adjacent a side rail;

attaching the pad body panel to the side rail to allow the pad body panel to move automatically with the side rail to at least partially occlude at least one of the following openings: between the side rail and a different side rail on a same side of the hospital bed, between the side rail and a head board, between the side rail and a footboard, and between the side rail and a mattress, the opening at least partially occluded when the side rail is in a lowered position, when the side rail is in an elevated position, and when the side rail moves between the lowered position and the elevated position, wherein the side rail is coupled to a side rail bracket arm and wherein the pad body panel and the side rail rotate about different axes of rotation with respect to the side rail bracket arm; and providing a semi-circular slot in the pad body panel to allow the pad body panel and the side rail to rotate about different axes of rotation with respect to the side rail bracket arm.

9. The method of claim 8, wherein attaching the pad body panel to the side rail to allow the pad body panel to move automatically with the side rail to at least partially occlude the at least one of the following openings further includes at least partially occluding the openings when a bed frame, to which the side rail is coupled, articulates between a planar configuration and a multi-planar configuration.

10. The method of claim 6 including positioning one of an aperture and an indentation in the pad body panel to allow for access to control components associated with the operation of the bed frame.

11. The method of claim 8 including positioning an extension of the pad body panel to occlude the opening between the side rail and the headboard.

12. The method of claim 11 including bending the extension of the pad body panel about a first predefined axis to occlude an opening between the side rail and the headboard.

13. The method of claim 11 including bending the extension of the pad body panel about a second predefined axis to occlude an opening between the side rail and the headboard.

14. The method of claim 8, wherein positioning the pad body panel includes: removing an end cap from the pad body panel;

fitting the pad body panel next to the side rail; and placing the end cap back on the pad body panel to attach the pad body panel to the side rail.

15. The method of claim 1 wherein attaching the pad body panel to the side rail comprises removing the side rail from the side rail bracket arm, placing the pad body panel on the side rail, and attaching the side rail to the side rail bracket arm.

16. The method of claim 1 wherein pad body panel rotates about a first axis of rotation centered on a pad pivot bolt and wherein the side rail rotates about a second axis of rotation centered on a pivot bearing.

* * * * *

UNITED STATES PATENT AND TRADEMARK OFFICE

CERTIFICATE OF CORRECTION

PATENT NO. : 8,020,225 B2
APPLICATION NO. : 12/484771
DATED : September 20, 2011
INVENTOR(S) : John H. Vrzalik et al.

It is certified that error appears in the above-identified patent and that said Letters Patent is hereby corrected as shown below:

In claim 10, column 10, line 7, delete "claim 6" and insert --claim 9-- therefor.

Signed and Sealed this
Third Day of July, 2012

David J. Kappos

David J. Kappos
*Director of the United States Patent and Trademark Office*